United States Patent [19]

Lewis, Jr.

[11] 4,298,134

[45] Nov. 3, 1981

[54] SYSTEM FOR REUSING PAINT CANS

[76] Inventor: Herman L. Lewis, Jr., 22 Marsh Creek Rd., Amelia Island, Fla. 32034

[21] Appl. No.: 168,205

[22] Filed: Jul. 10, 1980

[51] Int. Cl.[3] ..... B65D 41/18; B65D 25/16

[52] U.S. Cl. ..... 220/307; 220/306; 220/354; 220/404

[58] Field of Search ..... 220/354, 90, 404, 306, 220/307; 206/508

[56] References Cited

U.S. PATENT DOCUMENTS

| | | | |
|---|---|---|---|
| 3,052,371 | 9/1962 | Van Bemmelen | 220/404 |
| 3,173,574 | 3/1965 | Goldsmith | 206/508 |
| 3,309,000 | 4/1967 | Haverstick | 220/90 |
| 3,474,928 | 10/1969 | Harft | 206/508 |
| 3,980,213 | 9/1976 | Ramsay | 220/90 |

*Primary Examiner*—George E. Lowrance
*Attorney, Agent, or Firm*—Arthur G. Yeager

[57] ABSTRACT

A system for reusing paint cans comprising a paint can with a circular groove lip seal, a flexible plastic film bag liner to cover the interior surfaces of the can and with the opening of the bag folded back and draped downwardly over the upper outside portion of the can; and a semi-flexible plastic lid for said can having two downwardly depending concentric rings as shoulders bearing respectively against the outer and inner edges of said lip seal in a liquid-tight sealing relationship.

9 Claims, 3 Drawing Figures

SYSTEM FOR REUSING PAINT CANS

BACKGROUND OF THE INVENTION

It is common knowledge that paint cans of sizes up to at least one gallon are made with a circular groove lip seal that mates with a disc-shaped lid having a circular tongue that press fits into the groove to produce a tight seal. In custom paint blending shops any shade of color is available by mixing, according to a formula, two or more standard tints sold by the paint manufacturer. This normally requires the use of a new paint can which is thrown away after the consumer uses the paint. Since paint cans represent a substantial expense, it would be desirable to find a way to use such cans more than once, and it is an object of this invention to provide a system whereby such can be accomplished.

BRIEF SUMMARY OF THE INVENTION

This invention provides a system for reusing paint cans comprising a paint can with a circular groove lip seal for receiving a lid with a circular tongue complementary to said groove; a flexible plastic film bag liner to cover the inside surfaces of said paint can and with the open end of said bag turned back over said lip seal and draped downwardly over the upper outside of said can; and a circular semi-flexible plastic lid for said can having an outer shoulder depending from the outer edge of said cover to fit snugly over the bead joining the side wall of said can with said circular groove lip seal portion, and having a circular inner shoulder depending from said cover and spaced inwardly from and parallel to said outer shoulder and fitting snugly over the inner edge of said circular groove lip seal portion.

One embodiment of this invention is a semi-flexible plastic lid for a paint can having a circular grooved lip seal portion to receive a lid with a corresponding tongue; said plastic lid being in the form of a flat thin disc having an upper surface, a lower surface, and two concentric rings depending downwardly from said lower surface to form an inner shoulder and an outer shoulder to fit snugly, respectively, against the inner edge of said lip seal portion and the outer edge of said lip seal portion; said inner shoulder comprising a boss to contact the upper surface of said lip seal portion and a downwardly depending tapered ring to contact the inner edge of said lip seal portion; said outer shoulder comprising a downwardly depending ring at the perimeter of said plastic lid, the inner surface of said ring having a recess to accomodate the bead at the upper edge of said can and continuous projection at the bottom of said recess to contact the wall of said can below said bead.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
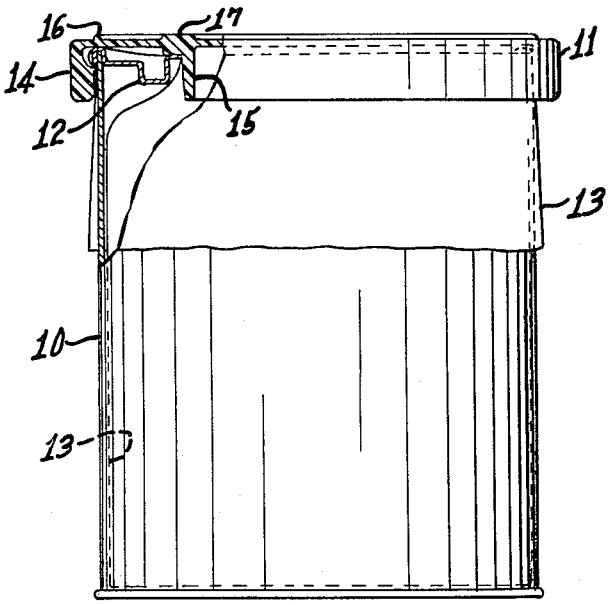
FIG. 1 is a front elevational view of the system of this invention.
Figure 2:
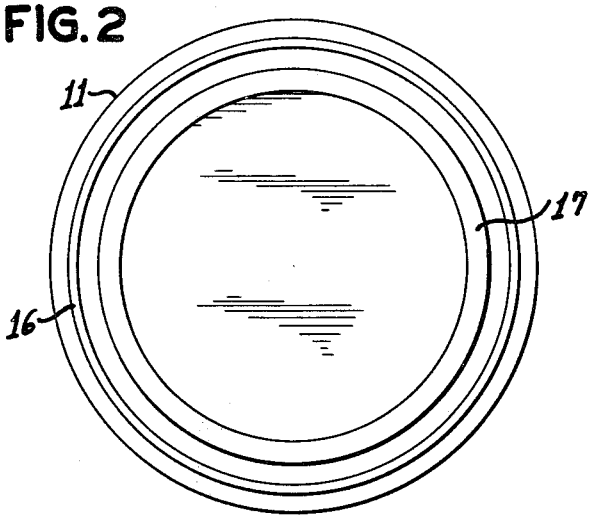
FIG. 2 is a top plan view of the system of this invention.

In FIGS. 1 and 2 there may be seen the system of this invention which involves a paint can 10, a flexible plastic film bag liner 13, and a semi-flexible plastic lid 11. It is the combination of these three items which makes up the present invention permitting paint can 10 to be reused several times. When a particular tint is required from a custom paint retailer he adds to a new paint can, such as 10 in the above drawings, the necessary ingredients from a supply of various paint tints and subjects the combination to a thorough shaking on a standard paint mixer. In many instances the consumer merely pours the paint out of the paint can 10 and into a receptacle for spraying or for brushing the paint on a surface. In this event the paint can 10 could be reused if there were means for preventing the paint from coating the can. The mere use of a flexible film bag liner 13 is not satisfactory, if the opening of the liner is draped over the outside of the can as shown in FIG. 1, because the metallic lid will rupture and tear the liner when it is put into place at the seal at the top of the can 10. In accordance with this invention a new lid 11 has been developed which will not cause liner 13 to tear and will permit sufficient sealing for the can and its contents of paint to be shaken on a commercial paint mixer.

In FIG. 1 liner 13 is an ordinary plastic film bag such as those commonly made from polyethylene. It is made in such a size that it will fully and efficiently open to the extent that substantially the entire volume of can 10 if available for paint. Liner 13 is made sufficiently long that the open end can be turned back over the opening of can 10 and draped down the outside for a substantial distance, e.g. $\frac{1}{4}$ to $\frac{1}{2}$ of the height of can 10.

Lid 11 has the general appearance of a semi-flexible plastic lid employed to cover cans of food, although it has special design features to serve the purposes of this invention. Such a liner can be made of low density polyethylene or other suitable plastic material. Lid 11 has an upper surface 11' facing outwardly from can 10 and a lower surface 11'' facing inwardly with respect to can 10. Depending downwardly from the lower surface 11' of lid 11 are two concentric rings forming outer shoulder 14 and inner shoulder 15. These two shoulders 14 and 15 are positioned and designed to fit snugly against, respectively, the outer and upper side wall portion of can 10 and the inner edge portion 26 of the circular groove of lip seal 12 of can 10 which has been designed to receive the usual metallic lid with a circular tongue sealing member. On the upper surface 11' of lid 11 are two concentric rings projecting slightly above upper surface 11'. Outer ring 16 is positioned to be directly above the wall of can 10 and the bead 18 which joins lip seal 12 to the outer surface of can 10. Inner ring 17 is designed to be directly above inner shoulder 15 and above the inner edge portion 26 of lip seal 12. The primary purpose of rings 16 and 17 is to provide pressure points for contact by the upper gripping surface of the standard paint mixer-shaker to which this can will be subjected. The contact with rings 16 and 17, assures a liquid-tight seal during the mixing-shaking operation.

Figure 3:
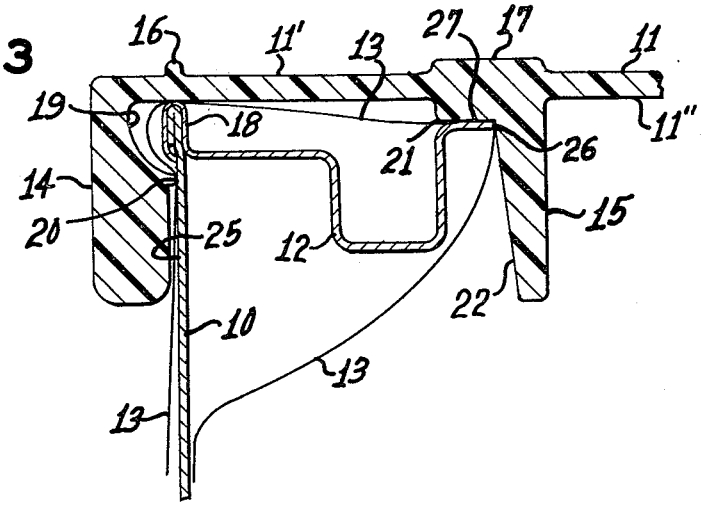
FIG. 3 is an enlarged cross-sectional view of the small portion shown in FIG. 1 in cross-section.

In FIG. 3 the details of the structure of lid 11 can best be seen. Can 10 and lip seal 12 are joined together by the manufacturer of the can in a rolling operation which produces bead 18 around the top edge of can 10. Outer shoulder 14 depends downwardly from lid 11 with the inner surface of shoulder 14 being designed with recess 19 that is sufficiently large to accomodate bead 18 and terminating in a small projection 20 which contacts the wall of can 10 at some convenient location immediately below bead 18. Lid 11 and shoulder 14 are made of sufficiently flexible material that it can be expanded to pass over bead 18 and then snap back into place to fit snugly against the wall of can 10.

Inner shoulder 15 depends downwardly from the lower surface 11'' of lid 11 and is designed to fit snugly against the inner edge of lip seal 12. Because lip seal 12 is made with inner edge portion 26 at a slightly lower elevation than the top of bead 18 lid 11 is fabricated with a boss 21 that will contact the upper surface 27 of lip seal 12 at inner edge portion 26. The remainder of inner shoulder 15 is a tapering portion 22 having its widest zone at the top end where it contacts boss 21 and its narrowest zone at the bottom of portion 22. This arrangement permits easy attachment of cover 11 to can 10 with a sealing arrangement when the cover has been pushed fully into place. It may be seen that flexible plastic film bag liner 13 passes between lid 11 and inner shoulder 15 where they contact lip seal 12 and also passes between lid 11 and shoulder 14 where they contact bead 18 and the side wall of can 10.

On the upper surface 11' of lid 11 are two concentric rings to serve as pressure points when sealing lid 11 onto the combination of liner 13 and can 10. Outer ring 16 is a projection which is substantially the same width as the thickness of bead 18 and is positioned immediately above bead 18. Inner ring 17 is another projection above upper surface 11' of lid 11 and is positioned immediately above boss 21 and tapered portion 22. The height of projections 16 and 17 is the same so that a flat plate which serves as the lid grip in paint mixer-shaker will contact both projections at the same time and with an equal pressure. The contact with the grip of the mixer-shaker will transmit sufficient manual pressure applied by the normal screw device which adjusts the gripper plate of the mixer-shaker to bead 18 and to the inner edge of lip seal 12 to form a liquid-tight seal and thereby prevent a leakage of any paint from inside of liner 13 to the outside of can 10.

In a preferred embodiment for use with a one-gallon paint can the thickness of the main portions of lid 11 is 0.047 inch; the length of shoulders 14 and 15 measured from upper surface 11' of lid 11 is 0.375 inch; and the height of projections 16 and 17 above upper surface 11' of lid 11 is 0.20 inch. Plastic bag liner 13 need not be any thicker than one mil (0.001 inch).

It is obvious that the system of this invention is not restricted to any particular size of paint can and that it may be used with various sizes with suitable alterations made to accomodate the standard containers for which this system is applicable. When it is convenient to do so lid 11 may be removed and the paint inside of liner 13 poured into another receptable. Since liner 13 is somewhat difficult to control when pouring paint out of such an open can, it may be desirable to merely cut a hole in lid 11 and pour the paint from the can through the hole without removing lid 11. In any event these procedures will permit can 10 to remain in a substantially new condition and able to be used again with a considerable savings in expense. A destruction of a lid with each use of the system of this invention is a minor expense compared to the savings accomplished by reusing can 10.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is new and what is desired to secure by Letters Patent of the United States is:

1. A system for reusing paint cans comprising a paint can with a circular groove lip seal adapted to receive a metallic lid with a circular tongue complementary to said groove; a flexible plastic film bag liner disposed within and covering the inside surfaces of said paint can and with the open end of said bag turned back over said lip seal and draped downwardly over the upper outside portion of said can; and a circular semi-flexible plastic lid for said can having a continuous outer shoulder depending from the lower surface of said cover adjacent its outer edge to fit snugly over the bead joining the side wall of said can with said circular groove lip seal portion, and having a continuous circular inner shoulder depending from said lower surface of said cover and spaced inwardly from and parallel to said outer shoulder and fitting snugly over the inner edge of said circular groove lip seal portion, said cover having projecting upwardly from the planar upper surface thereof an outer and an inner continuous and concentric ring, said outer ring being aligned immediately above said bead and being substantially as wide laterally as the lateral thickness of said bead and said inner ring being located immediately above said inner edge and laterally spanning outwardly and inwardly from said inner edge.

2. The system of claim 1 wherein said outer shoulder has an inner surface to contact said bead, said inner surface including a recessed portion to fit over said bead and an inwardly directed lip at the bottom of said recessed portion to fit the side wall of said can at the bottom of said bead.

3. The system of claim 1 wherein said inner shoulder comprises a boss to contact the top surface of said inner edge of said circular groove lip seal portion, said plastic lid having a lower surface and a downwardly depending tapered ring to contact the inner edge of said circular groove lip seal portion, said tapered ring being larger adjacent said lower surface and tapering downwardly to its free lower end.

4. The system of claim 1 wherein said outer and inner rings are substantially equal in height in their extent above said planar upper surface.

5. The system of claim 1 wherein said outer and inner shoulders are substantially equal in height in their extent below said lower surface.

6. A semi-flexible plastic lid for a metallic paint can having a circular grooved lip seal portion adapted to receive a metallic lid with a corresponding tongue, said plastic lid being in the form of a flat thin disc having a planar upper surface, a lower surface, and two concentric and continuous rings depending downwardly from said lower surface to form an inner shoulder and an outer shoulder to fit snugly, respectively, against the inner edge of said lip seal portion and the outer edge of said lip seal portion; said inner shoulder including a boss to contact the upper surface of said lip seal portion and a downwardly depending tapered and continuous ring to contact the inner edge of said lip seal portion; said outer shoulder including a downwardly depending ring at the perimeter of said plastic lid, the inner surface of said ring having a recess to accomodate the bead at the upper edge of said can and continuous projection at the bottom of said recess to contact the wall of said can below said bead, two spaced concentric and continuous rings projecting upwardly from said upper surface of the lid, one of said rings being aligned vertically above said bead and being substantially as wide as the thickness of said bead when viewed from above, the other of said rings being aligned vertically above said inner shoulder and being at least as wide as the thickness of said boss and the thickness of said tapered ring when viewed from above.

7. The lid of claim 6 wherein said tapered ring tapers from the smaller lower free end to the larger upper end adjacent said lower surface of said disc.

8. The lid of claim 6 wherein said rings projecting upwardly are substantially equal in height in their extent above said planar upper surface of said disc.

9. The lid of claim 6 wherein said rings projecting downwardly are substantially equal in height in their extent below said lower surface of said disc.

* * * * *